US005740511A

United States Patent [19]

Todome

[11] Patent Number: 5,740,511

[45] Date of Patent: Apr. 14, 1998

[54] CONVEYOR BELT DEVICE AND IMAGE FORMING APPARATUS HAVING THE DEVICE

[75] Inventor: Tuyoshi Todome, Kawasaki, Japan

[73] Assignee: Kabushiki Kaisha Toshiba, Kawasaki, Japan

[21] Appl. No.: 671,707

[22] Filed: Jun. 28, 1996

[30] Foreign Application Priority Data

Jun. 30, 1995 [JP] Japan ..... 7-166194

[51] Int. Cl.[6] ..... G03G 15/01

[52] U.S. Cl. ..... 399/303; 399/299

[58] Field of Search ..... 399/297, 298, 399/299, 300, 303; 271/198, 264; 198/804, 806, 807, 832, 835, 844.1, 845

[56] References Cited

U.S. PATENT DOCUMENTS

| | | | |
|---|---|---|---|
| 3,693,781 | 9/1972 | Homeier | 198/807 |
| 4,627,702 | 12/1986 | Anderson | 198/835 X |
| 5,017,969 | 5/1991 | Mitomi et al. | 399/299 |
| 5,467,171 | 11/1995 | Castelli et al. | 198/806 X |
| 5,481,338 | 1/1996 | Todome | 198/806 X |
| 5,515,139 | 5/1996 | Hou et al. | 198/807 X |

*Primary Examiner*—Sandra L. Brase
*Attorney, Agent, or Firm*—Foley & Lardner

[57] ABSTRACT

A color printer has four photoconductive drums and image forming sections provided corresponding to the drums, for forming images on the drums, respectively. A conveyor belt device has an endless belt which is stretched between a driving roller and a driven roller so as to convey a paper sheet in sequence to the drums. A regulation plate is arranged opposite to one end face of the driving roller, and slides in contact with one side edge of the conveyor belt. If a thickness of the conveyor belt is t (mm), a width of the conveyor belt in the axial direction of the driving roller is Bw (mm), a vertical elasticity coefficient in a width direction of the conveyor belt is E (g/mm$^2$), a load applied to the conveyor belt to stretch the conveyor belt is W (g/mm), and a diameter of the driving roller is D (mm), a distance L (mm) between the regulation member and the one end face of the driving roller is set so as to satisfy a following relationship:

$$L<(42.3\times D\times E\times t\times 10^{-3})/(W\times Bw).$$

13 Claims, 7 Drawing Sheets

(ROLLER DIAMETER D: 22mm, DISTANCE L: 2mm)

(ROLLER DIAMETER D: 22mm, DISTANCE L: 2mm)

(ROLLER DIAMETER D: 22mm, DISTANCE L: 30mm)

(ROLLER DIAMETER D: 50mm, DISTANCE L: 30mm)

CONVEYOR BELT DEVICE AND IMAGE FORMING APPARATUS HAVING THE DEVICE

BACKGROUND OF THE INVENTION

1. Field of the Invention

The present invention relates to an image forming apparatus, such as a color printer and an office color copier, for forming a color image on image forming mediums such as paper sheets using a plurality of photoconductive bodies, and a conveying apparatus applied to the image forming apparatus.

2. Description of the Related Art

A color copying machine has recently appeared in accordance with much demand for color copying in offices. As one example thereof, there is a quadruple drug type color copying machine. In this type of machine, four photoconductive drugs serving as image carriers, are arranged in parallel, toner images are formed on the respective drugs using toners of yellow, magenta, cyan and black, and these toner images are transferred onto a single image forming medium, thereby forming a color image.

Since, in the quadruple drum type color copying machine, toner images of different colors are sequentially superimposed on top of a image forming medium one on another, a dislocation of the image forming medium greatly affects the quality of images. To prevent this dislocation, the image forming medium is usually electrostatically adsorbed and fixed on a conveyor belt when it is conveyed. This method, however, has a serious problem in which if the conveyor belt is snaked, the image forming medium thereon is also snaked and a dislocation occurs at a transfer point and thereby causes a color shearing.

Conventionally, a perforation belt type conveyor device is proposed as a first system of preventing the above conveyor belt from being snaked. This type of conveyor device includes a conveyor belt having a plurality of feeding holes called perforations formed at regular intervals along either side of the belt, and a sprocket roller having a plurality of feeding pins protruding from the circumference of the roller and fitted into the feeding holes. If the feeding pins of the sprocket roller are fitted into the feeding holes of the conveyor belt, the conveyor belt is driven without sliding on the roller, and can be prevented from being snaked.

It is however technically difficult to form the plural feeding holes in the conveyor belt linearly at regular intervals. Since the intervals between the feeding holes depend upon the intervals between their corresponding feeding pins, the latter intervals have to be determined first. The outer diameter of the sprocket roller depends upon the intervals between the feeding pins.

Let us consider a sprocket roller the outer diameter of which is about 25 mm and on which feeding pins are formed at pitches of 15 mm. Since the outer circumference of this sprocket roller is about 78.5 mm, five feeding pins (78.5÷15=5.2) can be formed. To achieve the pitches of 15 mm when the five feeding pins are formed on the sprocket roller, the outer circumference should be 75 mm (=15×5) and the diameter should be 23.87324146 mm (=75÷π). In practice, however, the outer diameter of the sprocket roller can hardly be set closer than a whole number allowing the roller to be manufactured, because of restrictions on pitches and numbers of the feeding pins, and it is difficult to set the outside diameter of the sprocket roller to a desired value. Even though the sprocket roller is formed so as to have a desired outside diameter according to the pitches and the number of the feeding pins, it is difficult to form feeding holes linearly at regular intervals on the endless conveyor belt.

In the perforation belt type conveyor device, there may be a drawback even when the conveyor belt is driven. Since, in this conveyor device, the conveyor belt rotates and runs by fitting the feeding pins into the feeding holes, fatigue is likely to occur in the feeding holes. Since the feeding pins prevent the conveyor belt from being snaked, fatigue occurs in the conveyor belt. If the fatigue reach the limit thereof, the conveyor belt can crack or break. As described above, the perforation belt type conveyor unit has the drawbacks of increasing the cost and decreasing the reliability due to a change with time.

A lug belt type conveyor device is proposed as a second system of preventing the above conveyor belt from being snaked. According to this conveyor device, endless leaning prevention guides of lugs are mounted on and along either side edge of the inner surface of a conveyor belt, and a driven roller (a leaning prevention roller) slides between the leaning prevention guides, the length between both end faces of the driven roller being equal to an interval between adjacent leaning prevention guides, thereby preventing the conveyor belt from being snaked.

In order that the second system prevents the snaking of the conveyor belt, the following two conditions should be satisfied.

The first condition is that the straightness of the leaning prevention guides be made as straight as possible. In other words, since the conveyor belt is driven along the leaning prevention guides, if the faces of the leaning prevention guides contacting the driven roller are curved, the belt will be snaked due to the curved faces. It is thus necessary to bring the straightness of the leaning prevention guides as close as possible to zero.

The second condition is that the distance between opposing leaning prevention guides (the mounting width of the leaning prevention guides) be made as equal as possible to the length of the driven roller. If the distance is greater than the length, the conveyor belt is snaked by the difference between them. It is thus necessary to make the distance between opposing leaning prevention guides as equal as possible to the length of the driven roller.

In practice, the amount of snaking allowable for the conveyor belt is about 50 μm at its maximum and, in the lug belt type conveyor unit, the leaning prevention guides need to be fixed onto the conveyor belt with the maximum straightness of 25 μm on either side, i.e., the straightness of ±12.5 μm. The leaning prevention guides are usually constituted of rubber materials having enough flexibility to follow the conveyor belt, and it is very difficult to meet the requirement for the above straightness when the rubber-made leaning prevention guides are mounted on the conveyor belt.

The straightness of ±12.5 μm is based on the premise that there is no error in the mounting width of the leaning prevention guides. If the mounting width has a margin, the anticipated straightness for each of the leaning prevention guides should be set with higher accuracy.

In the lug belt type conveyor device described above, the technique of mounting the leaning prevention guides with high accuracy is required, and the accuracy can be hardly achieved. To achieve the accuracy, the cost of the conveyor belt becomes considerably high. Since the leaning prevention guides are generally constituted of rubber materials, the outer diameter and the hardness of rubber vary with time; therefore, the guides are difficult to handle.

A regulation plate type conveyor device is proposed as a third system of preventing the above conveyor belt from being snaked. According to this type of conveyor device, a conveyor belt is put on a driving roller and a tapered driven roller, and a bearing of the driven roller is energized by a compression spring in which direction it is separated from the driving roller, thus applying tension to the conveyor belt.

On one end side of the driving roller, a regulation plate serving as a member for regulating snaking of the belt, is provided in parallel to one side edge of the belt. The regulation plate is fixed separately from the conveyor belt and the driving roller and its flatness is set to 20 μm or less. The one side edge of the conveyor belt facing the plane of the regulation plate is polished such that its straightness is 30 μm or less.

Since the tapered driven roller is provided such that an end portion of its small-diameter section faces the regulation plate, if the driving roller is driven to move the conveyor belt, the belt slides down a slope of the driven roller and leans toward the regulation plate. Since, however, the regulation plate is fixed in the leaning direction, one side face of the conveyor belt, which is opposite to the regulation plate, slides in contact with the regulation plate. Both the force by which the belt slides down the driven roller and the force by which the regulation plate controls the belt prevent the belt from being snaked.

In the foregoing regulation plate type conveyor unit, that area of the regulation plate which contacts the one side face of the conveyor belt has only to be polished to have a flatness of 20 μm and, in actuality, the flatness can easily be achieved by processing a relatively small metallic member. Moreover, the straightness of 30 μm or less on the one side face of the conveyor belt can be relatively easily achieved by polishing the edge of the belt.

The above-described regulation plate type conveyor device is practically useful since it is constituted of parts obtainable from the present technology without increasing in cost.

However, the regulation plate type conveyor device cannot reliably prevent the belt from being snaked under every condition. For example, one side portion of the conveyor belt, that is, the sliding portion thereof collides with the regulation plate, and is rolled up and deformed, with the result that the belt is snaked. Reliably preventing the deformation of the sliding portion of the belt is not studied at all under the existing circumstances.

The perforation belt type and lug belt type conveyor devices both have the drawbacks of deteriorating in productivity, increasing in cost and decreasing in reliability due to a change with time. The regulation plate type conveyor device has the advantages of being manufactured easily at low cost and not being affected by a change with time, but has the problem in which the conveyor belt cannot be reliably prevented from being snaked if the sliding portion of the belt is deformed under certain conditions.

SUMMARY OF THE INVENTION

The present invention has been developed considering the above circumstances and one of its objects is to provide a conveying apparatus capable of effectively preventing a conveyor belt from being snaked and an image forming apparatus capable of forming an image of good quality.

To attain the above object, a belt conveyor device according to the present invention, comprises:

a driving roller and a driven roller facing each other with a predetermined distance;

a belt stretched between the driving roller and the driven roller, and running therebetween in accordance with rotation of the driving roller; and a regulation member arranged opposite to one end face of the driving roller in an axial direction thereof, and sliding in contact with one side edge of the belt, for regulating a snaking of the belt, wherein if a thickness of the belt is t (mm), a width of the belt in the axial direction of the driving roller is Bw (mm), a vertical elasticity coefficient in a width direction of the belt is E (g/mm$^2$), a load applied to the belt to stretch the belt is W (g/mm), and a diameter of the driving roller is D (mm), a distance L (mm) between the regulation member and the one end face of the driving roller is set so as to satisfy a following relationship:

$$L\ (mm) < (42.3 \times D \times E \times t \times 10^{-3})/(W \times Bw).$$

An image forming apparatus according to the present invention, comprises:

a plurality of image carriers arranged in parallel with one another;

a plurality of image forming means provided corresponding to the plurality of image carrying bodies, for forming images on the plurality of image carriers, respectively;

a conveyor belt device for conveying a image forming medium in sequence to the plurality of image carriers; and a plurality of transfer means provided corresponding to the plurality of image carriers, for transferring the images formed on the plurality of image carriers to the image forming medium conveyed by the conveyor belt device, the conveyor belt device including:

a driving roller and a driven roller facing each other with a predetermined distance;

a conveyor belt stretched between the driving roller and the driven roller, and running opposite to the plurality of image carriers in accordance with rotation of the driving roller thereby to convey the image forming medium; and a regulation member arranged opposite to one end face of the driving roller in an axial direction thereof, and sliding in contact with one side edge of the conveyor belt, for regulating a snaking of the conveyor belt, wherein if a thickness of the conveyor belt is t (mm), a width of the conveyor belt in the axial direction of the driving roller is Bw (mm), a vertical elasticity coefficient in a width direction of the conveyor belt is E (g/mm$^2$), a load applied to the conveyor belt to stretch the conveyor belt is W (g/mm), and a diameter of the driving roller is D (mm), a distance L (mm) between the regulation member and the one end face of the driving roller is set so as to satisfy a following relationship:

$$L < (42.3 \times D \times E \times t \times 10^{-3})/(W \times Bw).$$

According to the conveying apparatus and the image forming apparatus described above, if the relationship between the regulation plate, conveyor belt, and roller is clarified, the snaking of the conveyor belt can effectively be controlled at low cost by a simple method, even by using a regulation plate system which is not affected by a change with time. Thus, a color shearing due to the snaking of the belt is eliminated, and an image of good quality can be formed.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

FIGS. 1 to 3 are views of a quadruple drum type color printer according to an embodiment of the present invention, in which:

FIG. 1 is a cross-sectional view of the entire constitution of the color printer, FIG. 2 is a perspective view of a conveyor belt device and photoconductive drums, and FIG. 3 is a perspective view of the main part of the conveyor belt device;

DETAILED DESCRIPTION OF THE PREFERRED EMBODIMENTS

An image forming apparatus applied to a quadruple drum type color printer according to an embodiment of the present invention, will now be described in detail, with reference to the accompanying drawings.

Figure 1:
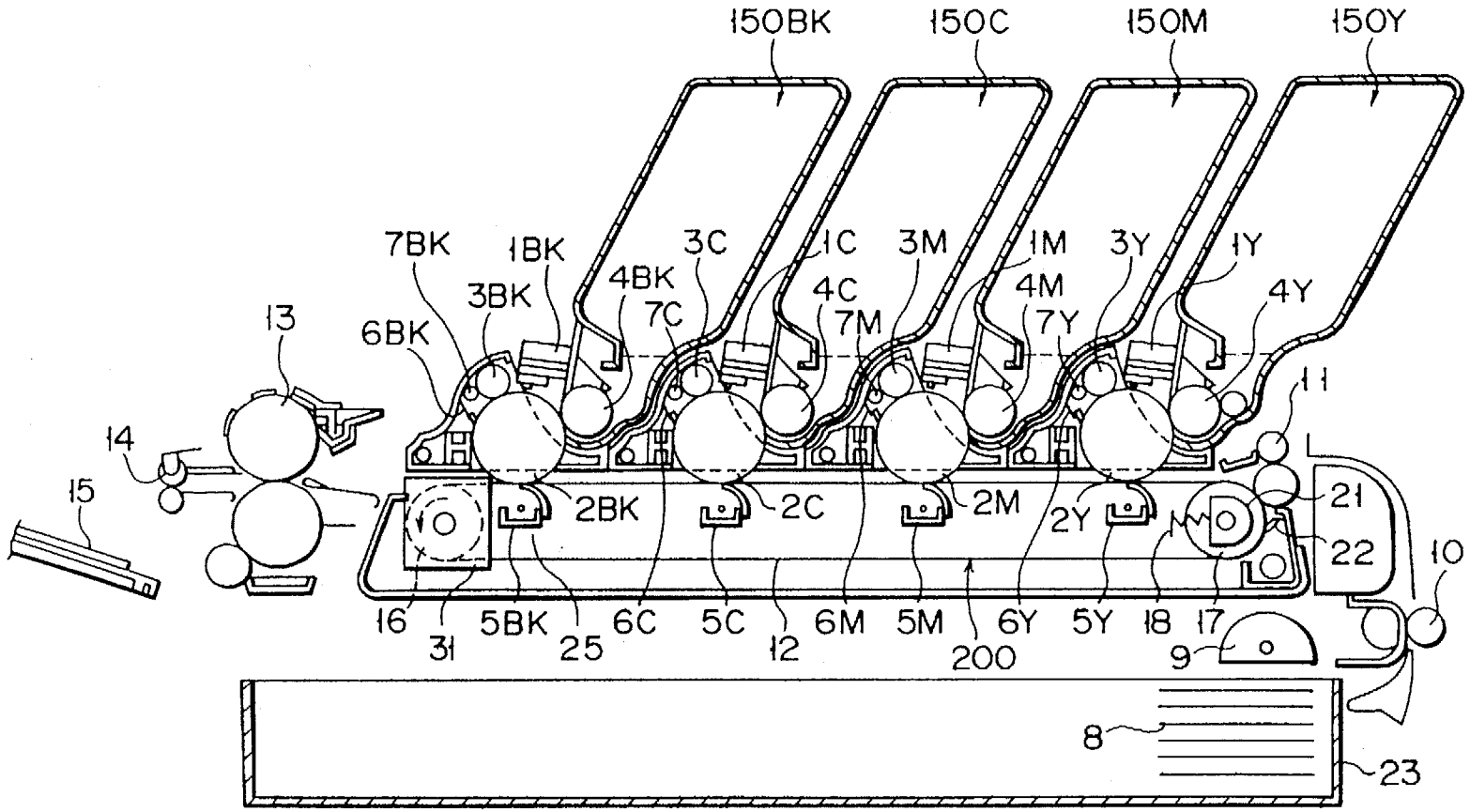

Referring to FIG. 1, the color printer comprises four photoconductive drums 2Y, 2M, 2C and 2BK serving as image carriers arranged in line, four image forming sections 150Y, 150M, 150C and 150BK corresponding to the photoconductive drums 2Y, 2M, 2C and 2BK, respectively, for forming images on the drums, a conveyor belt device 200 for conveying paper sheets 8, serving as image forming mediums, through the photoconductive drums 2Y, 2M, 2C and 2BE in order, and four transfer units 5Y, 5M, 5C and 5BK, serving as transfer means and corresponding to the photoconductive drums 2Y, 2M, 2C and 2BK, respectively, for transferring toner images formed on these drums to the paper sheets 8 conveyed by the conveyor belt device 200.

The four image forming sections 150Y, 150M, 150C and 150BK include solid-state scanning heads 1Y, 1M, 1C and 1BK, recording sections having equal-magnification image forming optical systems, charging units 3Y, 3M, 3C and 3BK, developing units 4Y, 4M, 4C and 4BK, cleaning units 6Y, 6M, 6C and 6BK, and discharge units 7Y, 7M, 7C and 7BK.

Since the image forming sections have the same constitution and perform the same operation, one of them, for example, the image forming section 150Y for forming a yellow image will be described.

Around the photoconductive drum 2Y corresponding to the yellow image forming section 150Y, the charging unit 3Y for charging the surface of the drum 2Y, the solid-state scanning head 1Y, developing unit 4Y, transfer unit 5Y, cleaning unit 6Y and discharge unit 7Y are arranged in sequence.

The photoconductive drum 2Y is rotated at a peripheral speed of V0 by a driving motor (not shown) and its surface is charged by the charging unit 3Y containing a charging roller having a conductivity and formed to contact the surface of the drum 2Y. Upon contacting the surface of the drum 2Y, the charging roller is rotated.

The surface of the photoconductive drum 2Y is formed of an organic photoconductor. The photoconductor, which is normally high in resistance, has a characteristic of varying the resistivity of an area irradiated with light. If, therefore, a light beam corresponding to a yellow printing pattern is emitted from the solid-state scanning head 1Y toward the charged surface of the yellow photoconductive drum 2Y through the equal-magnification image forming optical system, an electrostatic latent image of the yellow printing pattern is formed on the surface of the drum 2Y.

The electrostatic latent image is a so-called negative latent image which is formed when the light emission from the solid-state scanning head 1Y lowers the resistivity of the irradiated area of the photoconductor, and electric charges on the surface of the photoconductive drum 2Y flow, while the other electric charges remain on the area not irradiated with light.

The solid-state scanning head 1Y outputs exposure light to the photoconductive drum 2Y in accordance with yellow image data transmitted from a printing controller (not shown). The head 1Y includes a number of small-sized light emitting sections arranged at regular intervals in the main scanning direction. The head 1Y controls lighting of respective light emitting sections in response to ON and OFF signals supplied from the printing controller in accordance with a pattern to be printed, and forms a light image on the photoconductive drum 2Y by each of light beams emitted from the light emitting sections through the equal-magnification image forming optical system.

More specifically, an LED head array having resolution of 400 DPI is used as the solid-state scanning head 1Y, and a self-focusing lens array is employed as the equal-magnification image forming optical system.

If, as described above, a light beam is emitted from the head 1Y to the charged surface of the photoconductive drum 2Y and a latent image is formed thereon, the drum 2Y rotates to a development position at the speed of V0. In this position, the latent image is converted to a visible image or a toner image by the developing unit 4Y.

The developing unit 4Y includes yellow toners obtained by resin containing yellow dye. The yellow toners are stirred in the developing unit 4Y and charged by friction caused by the stir, and have charges of the same polarity as that of charges on the photoconductive drum 2Y. When the surface of the drum 2Y passes the developing unit 4Y, the yellow toners are electrostatically attached only to a latent-image area of the drum 2Y from which charges are removed, and the latent image is developed by the yellow toners (reversal development).

The photoconductive drum 2Y on which the yellow toner image is formed, continues to rotate at the speed of V0. In a transfer position, the toner image is transferred by the transfer unit 5Y onto the paper sheets 8 fed in predetermined timing from a paper feeding system (which will be described later).

The drum 2Y, which has passed the transfer position, rotates at the speed of V0. The toners and paper powders remaining on the drum 2Y are cleaned by the cleaning unit 6Y, and the potential on the drum surface is discharged to a constant level by a discharge lamp of the discharge unit 7Y. After that, the foregoing process starting with the operation of the charging unit 3Y is executed when the need arises.

A paper feeding cassette 23 containing paper sheets 8 one on top of another, a paper feeding mechanism for taking out the sheets one by one from the paper feeding cassette, and the conveyor belt device 200 (which will be described later) for conveying the taken-out sheets, are arranged under the image forming sections 150Y, 150M, 150C and 150 BK.

The paper feeding mechanism includes a pickup roller 9, feed rollers 10, resist rollers 11, a paper guide, and the like. The pickup roller 9 picks up the paper sheets 8 one by one from the cassette 23 and guides them to the feed rollers 10, and the feed rollers 20 carry the sheets to the resist roller 11. The resist rollers 11 adjust each paper sheet 8 in order and then sends it onto a conveyor belt 12 of the device 200.

The peripheral speed of the resist rollers 11 and the circumferential speed of the conveyor belt 12 are each set equal to the peripheral speed V0 of the photoconductive drum 2Y. Each paper sheet 8 is supplied to the transfer position of the drum 2Y together with the conveyor belt 12, at the same speed V0 as that of the drum 2Y, while part of the sheet 8 is being held between the resist rollers 11.

In the transfer position, the yellow toner image formed on the photoconductive drum 2Y contacting the paper sheet 8, is separated from the drum 2Y and transferred onto the paper sheet 8 by the transfer unit 5Y, thus forming a yellow toner image having a printing pattern corresponding to a yellow printing signal.

The transfer unit 5Y is constituted of a corona charger for generating coronas. The corona charger is arranged opposite to the photoconductive drum 2Y with the conveyor belt 12 interposed therebetween, and supplies, from the back of the conveyor belt 12, an electric field having a polarity which is opposite to that of the potential of the yellow toners electrostatically attached to the drum 2Y. This electric field acts on the yellow toner image on the drum 2Y through the conveyor belt 12 and the paper sheet 8, with the result that the toner image is transferred from the drum 2Y to the paper sheet 8.

The paper sheets 8 on which the toner image is transferred, are fed in sequence to the magenta image forming section 150M, cyan image forming section 150C, black image forming section 150BK.

These image forming sections 150M, 150C and 150BK have the same constitution as that of the section 150Y and perform the same operation as that thereof. Thus, the same elements are denoted by the same reference numerals with letters M, C and BK corresponding to letter Y, and their detailed descriptions are omitted.

The toner images of respective colors are superimposed one on another on the paper sheet 8 through the yellow, magenta, cyan and black transfer positions, and the sheet is sent to a fixing unit 13. The fixing unit 13 has a heat roller incorporating a heater by which the toner image positioned on the surface of the sheet only by charging force is heated, and the superimposed toner image is melted, thus permanently fixing the image onto the paper sheet 8. This sheet 8 is then carried in a paper discharging tray 15 by feeding rollers 14.

After the conveyor belt 12 sends out the paper sheet 8 to the fixing unit 13, the toners and paper powders remaining on the surface of the belt 12 are cleaned by a belt cleaning unit 22 and, when necessary, the belt 12 conveys the next paper sheet 8.

In monochromatic printing, an image of one color is formed by a recording section and an image forming section for the color. None of the other recording and image forming sections for colors other than the selected one are operated.

The conveyor belt device 200 will now be described in detail with reference to FIGS. 1 to 3.

The device 200 serving as a conveying apparatus includes a supporting frame 52 having a pair of parallel sidewalls 50*a* and 50*b* arranged at regular intervals and opposite to each other. A driving roller 16 and a tapered driven roller 17 are arranged in parallel to each other and rotatably supported between the sidewalls 50*a* and 50*b*. The driving roller 16 and the driven roller 17 are spaced from each other by a predetermined distance. The endless conveyor belt 12 whose width is almost equal to the length of each photoconductive drum, is stretched between the driving and driven rollers 16 and 17. The belt 12 is so stretched that its upper portion runs between the photoconductive drums 2Y, 2M, 2C and 2BK and the transfer units 5Y, 5M, 5C and 5BK.

Figure 2:
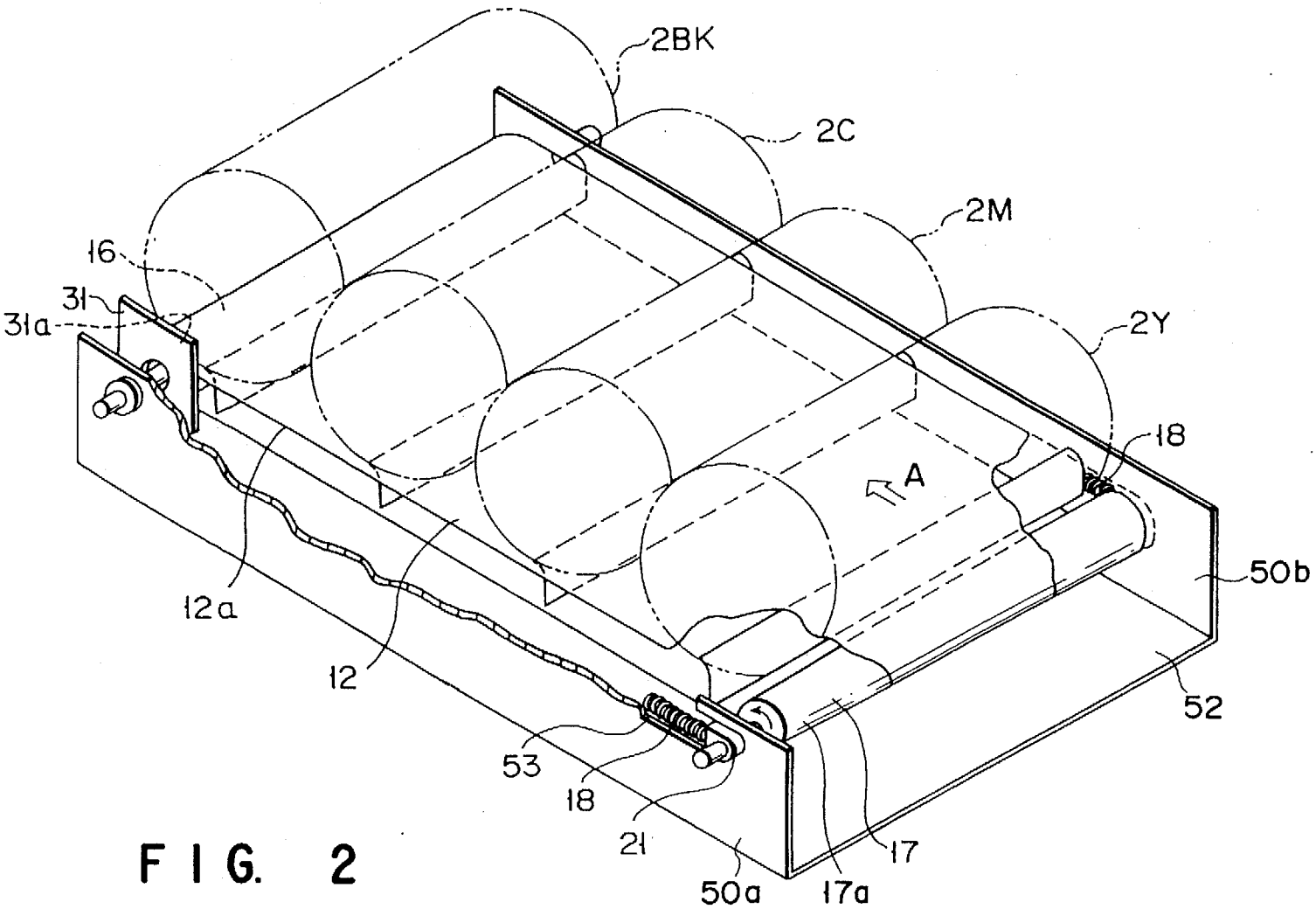
Figure 3:
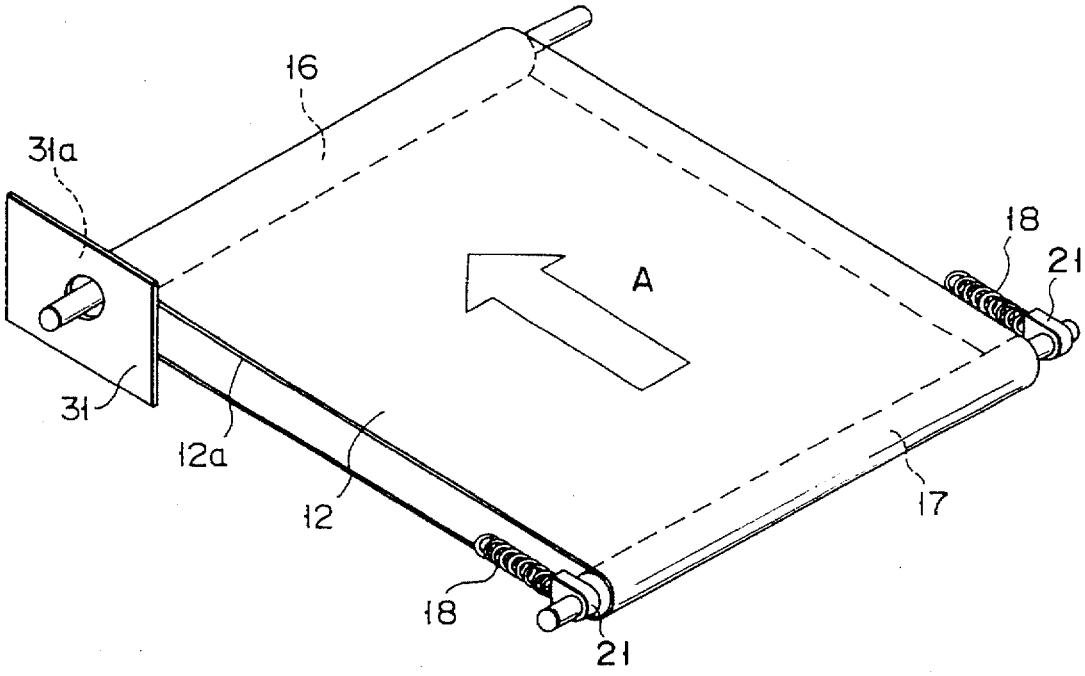

The driving roller 16 is rotated counterclockwise (in the Figures) upon receiving a driving force from the driving motor (not shown), and the conveyor belt 12 runs in the direction of arrow A in FIG. 2. The driving roller 16 is then driven such that the peripheral speed V0 of the photoconductive drums and the running speed of the conveyor belt are equal to each other.

The driven roller 17 is supported movably in the paper feeding direction A which is perpendicular to the axis of each of the photoconductive drums, and urged in a direction opposite to the direction A by means of compression springs 18, thereby applying a tensile load to the conveyor belt 12. Specifically, each of the sidewalls 50*a* and 50*b* of the supporting frame 52 has an elongate hole 53 extending in parallel to the paper feeding direction A, and a supporting member 21 is slidably fitted in the hole 53. Both ends of the rotating shaft of the driven roller 17 are rotatably supported by their respective supporting members 21. Each of the compression springs 18 is interposed between its corresponding supporting member 21 and sidewall.

In the conveyor belt device 200, a regulation plate system is adopted to prevent the conveyor belt 12 from being snaked and leaned.

The device 200 has a rectangular regulation plate 31 functioning as a belt regulation member. The regulation plate 31 is fixed onto one (50*a*) of the sidewalls of the supporting frame 52 and arranged in parallel to a front end face of the driving roller 16, that is, an end face of the driven roller 17 at which a small-diameter section 17*a* of the roller 17 is located.

The regulation plate 31 is processed such that its plane 31*a* facing the driving roller 16 has a flatness of 20 μm or less. The conveyor belt 12 is polished such that its one side edge 12*a* opposite to the plane 31*a* has a straightness of 30 μm or less.

If the driving roller 16 is driven, the conveyor belt 12 runs in the direction A and is gradually leaned toward the small-diameter section 17*a* of the roller 17 or the front end face of the roller 16 since the driven roller 17 is tapered. As the belt 12 is leaned more and more, its one side face 12*a* contacts the regulation plate 31 and slides on the plane 31*a* of the plate 31.

Since the regulation plate 31 is in a stationary state, if a predetermined amount of leaning of the belt 12 increases, the force by which the belt 12 is pushed against the plate 31 is proportionate to the reaction force generated therefrom, thus preventing the belt 12 from being leaned.

Since the snaking force of the conveyor belt 12 is generally smaller than the leaning force thereof, it is included in the leaning force and in the reaction force from the regulation plate 31 when the leaning force is proportionate to the reaction force, with the result that the conveyor belt 12 is not snaked. The length of the tapered driven roller 17 is as great as the width of the belt 12, and its tapered shape has effect on the entire belt.

In the foregoing regulation plate system, that area of plane 31*a* of regulation plate 31 which contacts the side edge 12*a* of the belt 12, has only to be finished so as to have a flatness of 20 μm and, actually, such a plate can easily be formed by processing a relatively small metallic member with a flatness of 20 μm or less. By polishing the edge of the belt 12, the side face 12*a* of the belt 12 can also be processed relatively easily so as to have a straightness of 30 μm or less. The parts used in the foregoing regulation plate system can be obtained by the present processing technique without increasing in costs.

Though the above-described regulation plate system is inexpensive and simple, and not influenced by change with time, the conveyor belt 12 can be prevented more effectively from being snaked, if the relationship among the regulation plate 31, conveyor belt 12 and driving roller 16 is clarified, as will be described later. Consequently, a color shearing due to the snaking of the belt 12 can be eliminated, thereby making it possible to form an image of good quality.

Figure 4:
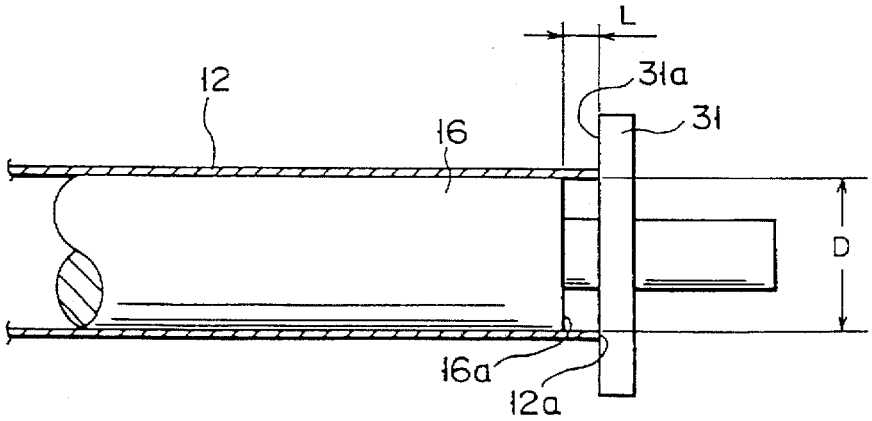
FIG. 4 is a schematic view showing the state of a conveyor device when the distance L between a regulation plate and an end face of a driving roller of the conveyor belt device is 2 mm, and the outer diameter D of the driving roller is 22 mm.

The inventor did experiments on the relationship between distance L between the regulation plate 31 and the end face 16*a* of the driving roller 16, and an amount of belt snaking due to a deformation of the conveyor belt 12. The results of the experiments will be described with reference to FIGS. 4 to 6.

The experiments confirmed that in the regulation plate system the distance L greatly affected a sliding portion of the belt 12. For example, in FIG. 4, the outer diameter D of the driving roller 16 is 22 mm, and the distance L is 2 mm. In this case, the conveyor belt 12 was not distorted even by the leaning force of 1 kg generated between the side face 12*a* of the belt 12 and the regulation plate 31, and thus the belt 12 was not snaked.

Figure 5:
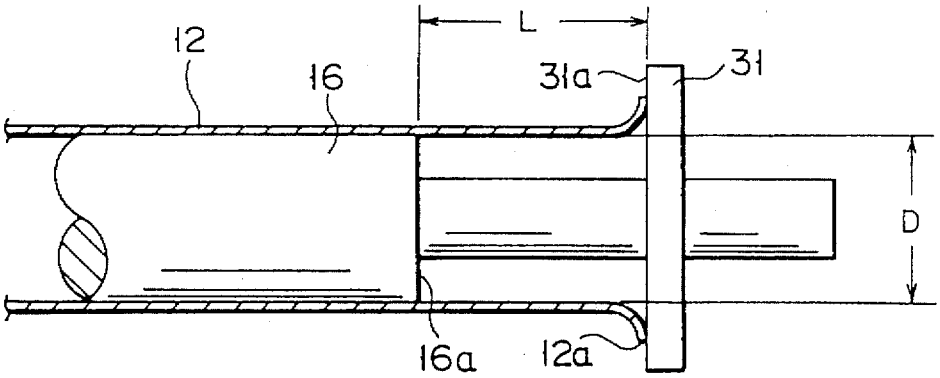
FIG. 5 is a schematic view showing the state of the conveyor belt when the distance L is 30 mm and the outer diameter D is 22 mm.

However, when the distance L is 30 mm and the outer diameter D is 22 mm as shown in FIG. 5, the side face 12*a* was easily distorted and the belt 12 was snaked accordingly.

Figure 6:
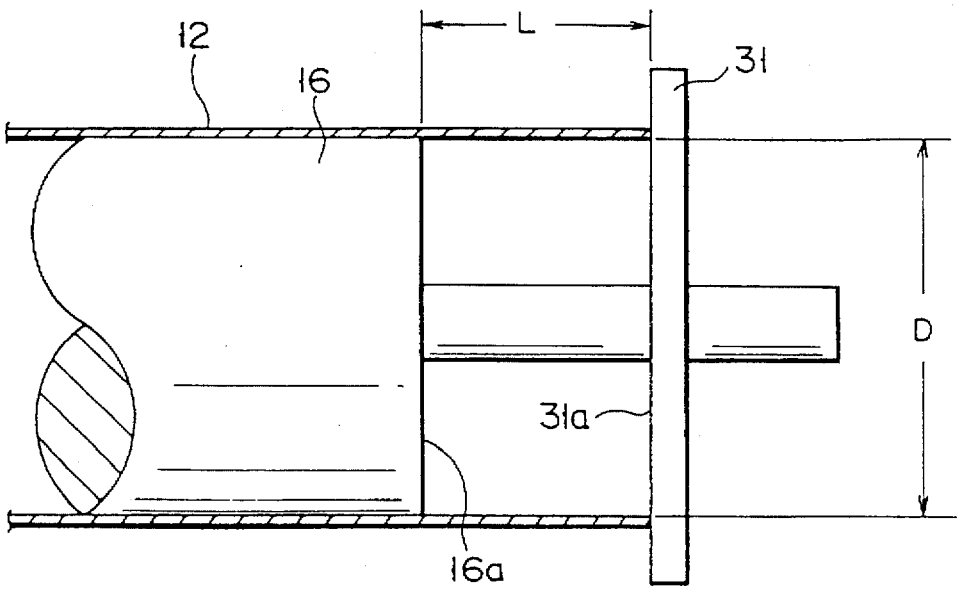
FIG. 6 is a schematic view showing the state of a conveyor belt when the distance L is 30 mm and the outer diameter D of the driving roller is 50 mm.

When the distance L is 30 mm but the outer diameter D is 50 mm as shown in FIG. 6, the conveyor belt 12 was not distorted by the leaning force.

Furthermore, the belt 12 was not distorted either when its thickness t is great or the vertical elasticity coefficient E of a vector in which direction the leaning force is exerted. The reason the belt can be prevented from being distorted by simply increasing the outer diameter D of the driving roller 16, is that the contact area of the belt 12 on the roller 16 is increased and thus the cross section of the belt 12 on which the leaning force is exerted can be enlarged. If, therefore, the same leaning force is exerted, the distance L can be set longer as the outside diameter D becomes greater. The distortion of the conveyor belt 12 due to the leaning force causes the belt 12 to be snaked, and affects the belt in combination with the other parameters.

In the above experiments, using the outside diameter D (mm) of the driving roller, the vertical elasticity coefficient E (kg/mm$^2$) in the direction of the regulation plate, and the thickness t (mm) of the belt, as parameters, the distance L (mm) was measured to obtain the maximum one such that the amount of belt snaking could fall within a predetermined reference value. The amount of belt snaking was judged using the maximum amount of snaking of 50 μm as a reference value. The judgment is rejected when the amount exceeds the reference value and accepted when it is equal to or smaller than the reference value.

The above parameters used in the experiments are as follows:

D (mm) . . . , 5, 10, 20, 30, . . . , 100

E (kg/mm$^2$) . . . , 300, 400, 500, 600, 700 t (mm) . . . , 0.04, 0.06, 0.08, 0.1, 0.2, 0.3, 0.4, 0.5, 0.6, 0.7, 0.8

Figure 7:
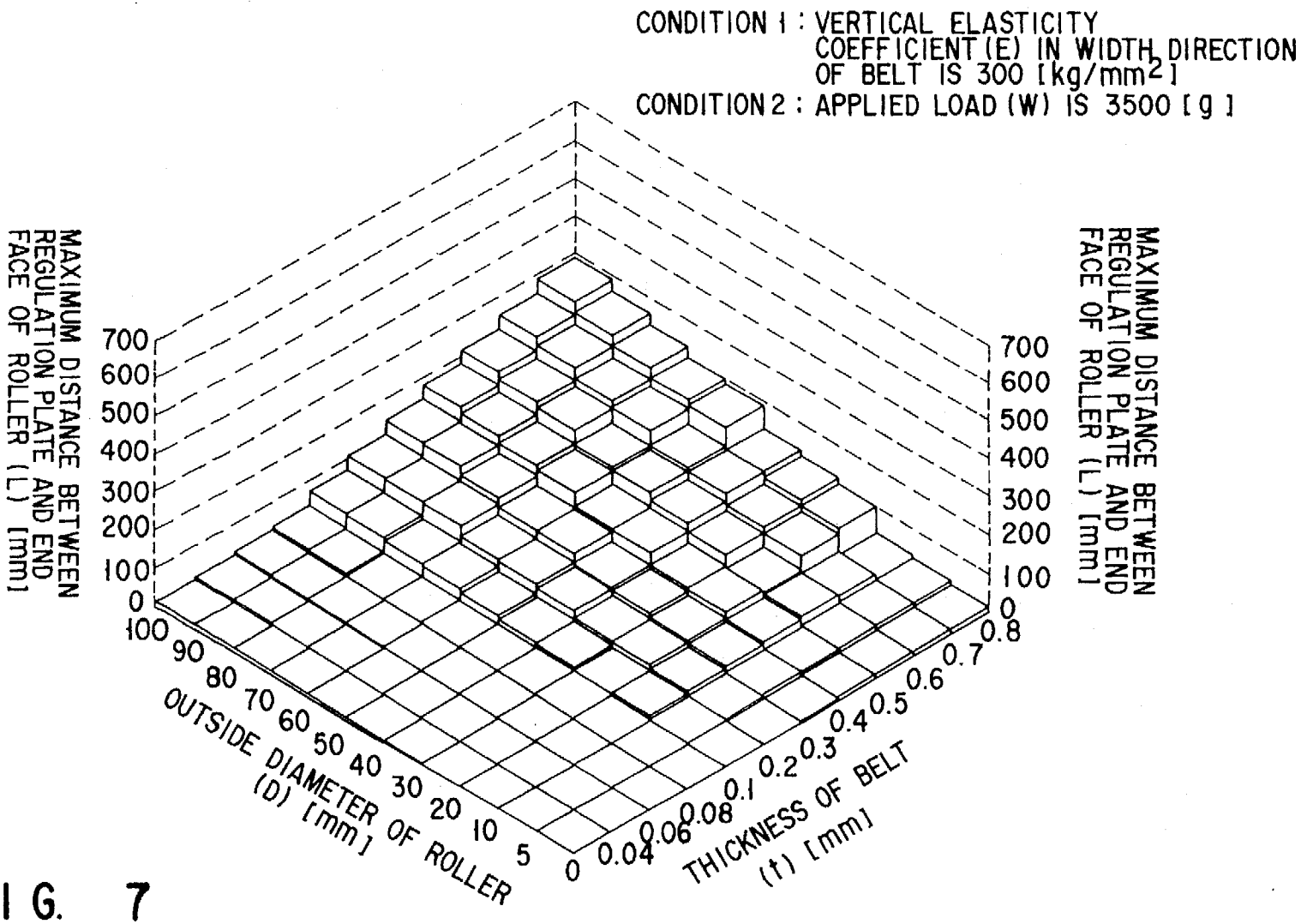
FIG. 7 is a graph showing the relationship among the thickness t of the belt, the outer diameter D and the distance L when the vertical elasticity coefficient of the belt is 300 $kg/mm^2$.
Figure 8:
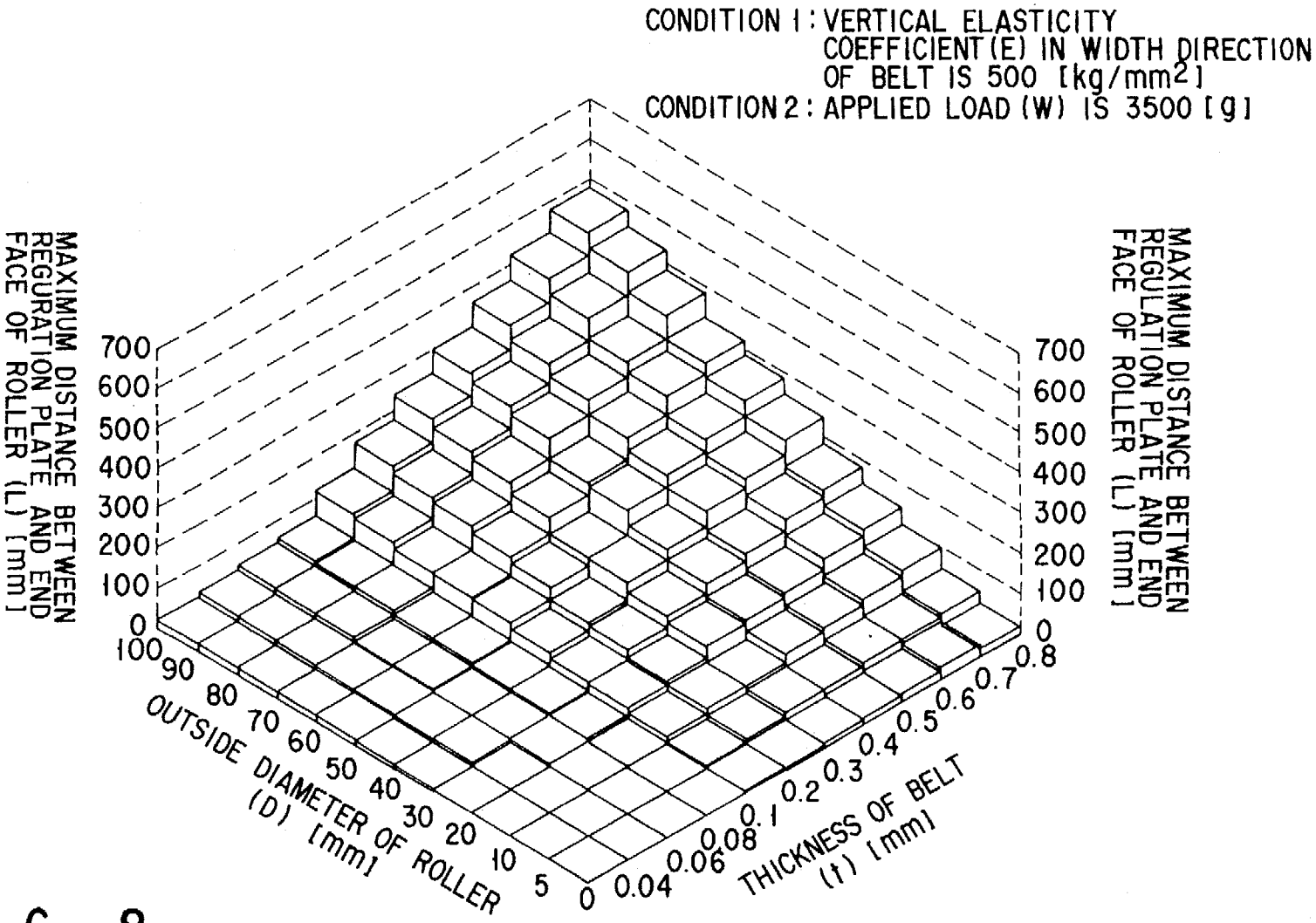
FIG. 8 is a graph showing the relationship among the thickness t, the outer diameter D and the distance L when the vertical elasticity coefficient is 500 $kg/mm^2$.
Figure 9:
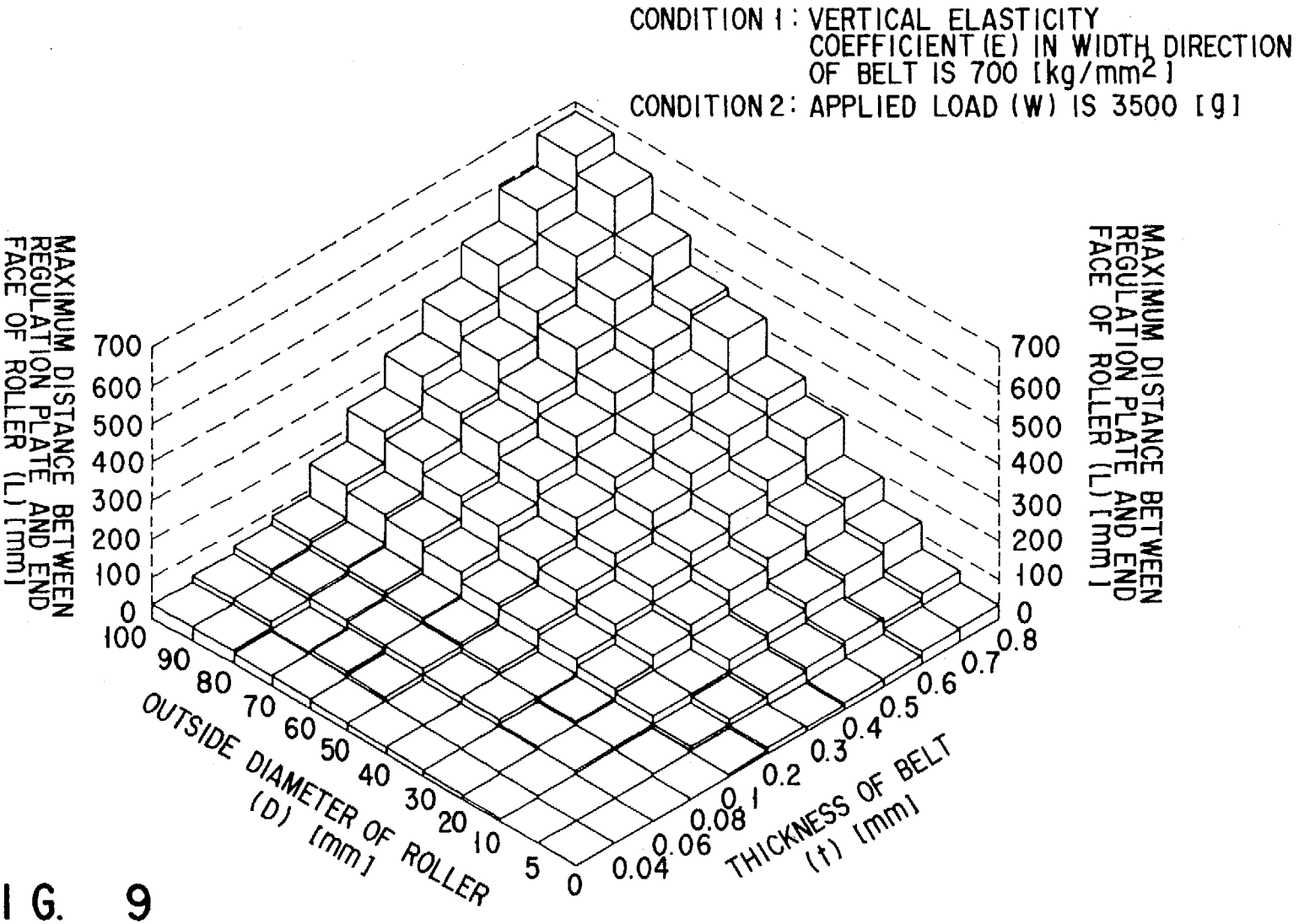
FIG. 9 is a graph showing the relationship among the thickness t, the outside diameter D and the distance L when the vertical elasticity coefficient is 700 $kg/mm^2$.

Based on the above, the maximum distance L (mm) was obtained with a range in which the amount of belt snaking did not exceed 50 μm. This maximum distance L is applied to three cases of different vertical elasticity coefficients E as shown in FIGS. 7 to 9. The load W applied to the conveyor belt 12 for stretching the belt was set to an appropriate value (tension by which the belt is stretched between the rollers without being slacked) according to the thickness and vertical elasticity coefficient of the belt. For the experiments, a belt containing polyimide as the principal ingredient was employed as the conveyor belt 12.

In FIGS. 7 to 9, the x-axis, y-axis, and z-axis indicate the outside diameter D (mm) of the driving roller, the thickness t (mm) of the conveyor belt, and the maximum distance L (mm) between the driving roller and regulation plate, respectively.

FIG. 7 shows the experimental result when E is 300 kg/mm$^2$ and W is 3500 g, FIG. 8 shows it when E is 500 kg/mm$^2$ and W is 3500 g, and FIG. 9 shows it when E is 700 kg/mm$^2$ and W is 3500 g.

It has been understood from the experiments that the maximum distance L increases as the outside diameter D, the thickness t, or the vertical elasticity coefficient E becomes greater. In other words, these three factors are proportionate to the maximum distance L.

Examples of the results concerning the relationship between the applied load W and maximum distance L, are shown in the following Tables 1 and 2. Since an appropriate value of the applied load W varies with the width of the conveyor belt, the load W is represented using a unit (g/mm). Thus, 13.4 g/mm is equivalent to the load of about 4000 g applied to the belt whose width is 300 mm.

If the outside diameter D is 20 mm, the thickness t is 0.1 mm, and the vertical elasticity coefficient E is 400 kg/mm$^2$, the following results were obtained.

TABLE 1

| Applied Load W(g/mm) | 8 | 10 | 12 | 14 | 16 | 18 | 20 |
|---|---|---|---|---|---|---|---|
| Maximum Distance L(mm) | x | x | 10 | 9.3 | 8.6 | x | x |

If the outer diameter D is 20 mm, the thickness t is 0.1 mm, and the vertical elasticity coefficient E is 650 kg/mm$^2$ the following results were obtained.

TABLE 2

| Applied Load W(g/mm) | 8 | 10 | 12 | 14 | 16 | 18 | 20 | 22 |
|---|---|---|---|---|---|---|---|---|
| Maximum Distance L(mm) | x | x | 18 | 15 | 13 | 11 | 10 | x |

It is understood from the above experimental results that the load applied to the conveyor belt is in inverse proportion to the maximum distance L between the driving roller and regulation plate.

The same experiments as described above were carried out using a belt constituted of polycarbonate. The results of the experiments are virtually the same as those of the above experiments using the belt containing polyimide, and the three-dimensional graph representing the results is the same; therefore, the description of the results are not repeated.

Examples of the relationship between load W applied to the belt of polycarbonate and maximum distance L, are shown in the following Tables 3 and 4. Since an appropriate value of the applied load W varies with the width of the belt, the load W is represented using a unit (g/mm). Thus, 13.4 g/mm is equivalent to the load of about 4000 g applied to the belt whose width is 300 mm.

If the outer diameter D of the driving roller is 20 mm, the thickness t of the belt is 0.1 mm, and the vertical elasticity coefficient E in the width direction of the belt is 250 kg/mm$^2$, the following results were obtained.

TABLE 3

| Applied Load W(g/mm) | 8 | 10 | 12 | 14 | 16 | 18 | 20 |
|---|---|---|---|---|---|---|---|
| Maximum Distance L(mm) | x | 6.8 | 5.2 | 4.8 | 3.2 | x | x |

If the outer diameter D is 20 mm, the thickness t is 0.1 mm, and the vertical elasticity coefficient E is 180 kg/mm$^2$, the results were as follows:

TABLE 4

| Applied Load W(g/mm) | 8 | 10 | 12 | 14 | 16 | 18 | 20 |
|---|---|---|---|---|---|---|---|
| Maximum Distance L(mm) | 5.8 | 4.9 | 3.9 | 3.2 | 2.8 | 1.1 | x |

Furthermore, the same experiments as described above were performed using a belt of PES alloy. The results of the experiments are virtually the same as those of the above experiments using the belts of polyimide and polycarbonate, and the three-dimensional graph representing the results is the same; therefore, the description of the results are not repeated.

Examples of the relationship between load W applied to the belt of PES alloy and maximum distance L, are shown in the following Tables 5 and 6. Since an appropriate value of the applied load W varies with the width of the belt, the load W is represented using a unit (g/mm). Thus, 13.4 g/mm is equivalent to the load of about 4000 g applied to the belt whose width is 300 mm.

If the outside diameter D of the driving roller is 20 mm, the thickness t of the belt is 0.1 mm, and the vertical elasticity coefficient E in the width direction of the belt is 280 kg/mm$^2$ the following results were obtained.

TABLE 5

| Applied Load W(g/mm) | 8 | 10 | 12 | 14 | 16 | 18 | 20 |
|---|---|---|---|---|---|---|---|
| Maximum Distance L(mm) | 9.2 | 7.5 | 6.9 | 5.1 | 3.5 | x | x |

If the outside diameter D is 20 mm, the thickness t is 0.1 mm, and the vertical elasticity coefficient E is 350 kg/mm$^2$, the results were as follows:

TABLE 6

| Applied Load W(g/mm) | 8 | 10 | 12 | 14 | 16 | 18 | 20 |
|---|---|---|---|---|---|---|---|
| Maximum Distance L(mm) | 11 | 9.7 | 7.8 | 6.8 | 5.9 | 5.2 | 4.5 |

An approximation formula for calculating the maximum distance L (mm) between the end face 16*a* of the driving roller 16 and the regulation plate 31, is obtained on the basis of the above experimental results. The formula is as follows.

$$L\ (mm) < (42.3 \times D \times E \times t) \times 10^{-3} / (W \times Bw)$$

where

L (mm): maximum distance between driving roller and regulation plate

D (mm): diameter of driving roller

E (g/mm$^2$): vertical elasticity coefficient t (mm): thickness of conveyor belt W (g/mm): load applied to conveyor belt in width of 1 mm Bw (mm): width of conveyor belt The approximation formula is very consistent with the foregoing experimental results, and represents that maximum distance L is proportionate to outside diameter D, vertical elasticity coefficient E, and thickness t, and it is in inverse proportion to load W and width Bw. If the driving roller 16 and regulation plate 31 are arranged so as to satisfy the above formula, the conveyor belt 12 can be prevented from being distorted, and the amount of snaking can be decreased to 50 μm or less. Furthermore, a conveyor belt snaking prevention mechanism can be operated effectively in the regulation plate system.

In this embodiment, the distance L is set to a value satisfying the formula, e.g., 6 mm.

The maximum distance L is specifically calculated from the above formula, as follows.

$$(42.3 \times D \times E \times t \times 10^{-3})/(W \times Bw) = (42.3 \times 20 \times 430000 \times 0.1 \times 10^{-3})/3500 = 10.4$$

By setting the distance L to 6 mm so as to satisfy the condition that L<10.4 mm, the amount of snaking of the conveyor belt 12 can effectively be decreased without distorting the sliding edge of the belt 12 in the regulation plate system.

According to the conveyor belt unit having the above constitution, the conveyor belt can be prevented from being distorted and snaked at low cost and with reliability in the regulation plate system. Using this conveyor belt unit, a color shearing due to the snaking of the conveyor belt can be eliminated, resulting in a color copier capable of forming an image of good quality.

The present invention is not limited to the above embodiment but various changes and modifications can be made without departing from the scope of the subject matter of the present invention. For example, in the above embodiment, the direction of the leaning force of the conveyor belt is controlled by the tapered driven roller. This control method is, however, one example and, even if it is combined with another control method, the advantage of the present invention remains unchanged.

In the above embodiment, the mechanism for preventing the conveyor belt for carrying image forming mediums from being snaked, is employed, but the present invention can be applied to an image carrying belt used in an image forming apparatus which is constructed that an image is carried directly by the belt. Moreover, the present invention can be applied to not only the foregoing color printer but also another image forming apparatus such as a color copier.

What is claimed is:

1. A conveying apparatus comprising:

a driving roller and a driven roller arranged to face each other with a predetermined distance;

a belt stretched between the driving roller and the driven roller, and running therebetween in accordance with rotation of the driving roller; and a regulation member arranged opposite to one end face of the driving roller in an axial direction thereof, and sliding in contact with one side edge of the belt, for regulating a snaking of the belt, wherein if a thickness of the belt is t (mm), a width of the belt in the axial direction of the driving roller is Bw (mm), a vertical elasticity coefficient in a width direction of the belt is E (g/mm$^2$), a load applied to the belt to stretch the belt is W (g/mm), and a diameter of the driving roller is D (mm), a distance L (mm), between the regulation member and the one end face of the driving roller is set so as to satisfy a following relationship:

$$L<(42.3\times D\times E\times t\times 10^{-3})/(W\times Bw).$$

2. The conveying apparatus according to claim 1, further comprising direction control means for leaning the belt toward the regulation member.

3. The conveying apparatus according to claim 2, wherein the driven roller includes a tapered circumferential surface and a small-diameter end portion located on the side on which the regulation member is located.

4. The conveying apparatus according to claim 1, wherein the belt contains one of polyimide and polycarbonate as a principal ingredient.

5. The conveying apparatus according to claim 1, wherein the regulation member includes a regulation plate having a plane slidably contacting the one side edge of the belt.

6. The conveying apparatus according to claim 5, further comprising supporting means for rotatably supporting the driving roller and the driven roller, and wherein the regulation plate is fixed to the supporting means.

7. An image forming apparatus comprising:

a plurality of image carriers arranged in parallel with one another;

a plurality of image forming means provided corresponding to the plurality of image carriers, for forming images on the image carriers, respectively;

a conveyer belt device for conveying an image forming medium in sequence to the image carriers; and a plurality of transfer means provided corresponding to the plurality of image carriers, for transferring the images formed on the plurality of image carriers to the image forming medium conveyed by the conveyor belt device, wherein the conveyor belt device includes:

a driving roller and a driven roller arranged to face each other with a predetermined distance;

a conveyor belt stretched between the driving roller and the driven roller, and running opposite to the plurality of image carriers in accordance with rotation of the driving roller thereby to convey the image forming medium; and a regulation member arranged opposite to one end face of the driving roller in an axial direction thereof, and sliding in contact with one side edge of the conveyor belt, for regulating a snaking of the conveyor belt, and wherein if a thickness of the belt is t (mm), a width of the conveyor belt in the axial direction of the driving roller is Bw (mm), a vertical elasticity coefficient in a width direction of the conveyor belt is E (g/mm$^2$), a load applied to the conveyor belt to stretch the conveyor belt is W (g/mm), and a diameter of the driving roller is D (mm), a distance L (mm), between the regulation member and the one end face of the driving roller is set so as to satisfy a following relationship:

$$L<(42.3\times D\times E\times t\times 10^{-3})/(W\times Bw).$$

8. The image forming apparatus according to claim 7, wherein the conveyor belt device further includes direction control means for leaning the conveyor belt toward the regulation member.

9. The image forming apparatus according to claim 8, wherein the driven roller includes a tapered circumferential surface and a small-diameter end portion located on the side on which the regulation member is located.

10. The image forming apparatus according to claim 7, wherein the conveyor belt contains one of polyimide and polycarbonate as a principal ingredient.

11. The conveyor belt device according to claim 7, wherein the regulation member includes a regulation plate having a plane slidably contacting the one side edge of the conveyor belt.

12. The conveyor belt device according to claim 11, wherein the conveyor belt device further includes supporting means for rotatably supporting the driving roller and the driven roller, and the regulation plate is fixed to the supporting means.

13. An image forming apparatus comprising:

a plurality of image carriers arranged in parallel with one another;

a plurality of image forming means provided corresponding to the plurality of image carriers, for forming images of different colors on the plurality of image carriers;

a conveyer belt device having an endless conveyor belt stretched between a driving roller and a driven roller such that the conveyor belt faces the plurality of image carriers, the conveyor belt device conveying an image forming medium in sequence to the plurality of image carriers; and a plurality of transfer means provided corresponding to the plurality of image carriers, for sequentially transferring the images, formed on the plurality of image carriers, to an image forming medium conveyed by the conveyor belt device, while being put one on another, wherein the conveyor belt device including a regulation member arrange opposite to one end face of the driving roller in an axial direction thereof, and sliding in contact with one side edge of the conveyor belt, for regulating a snaking of the conveyor belt, and, if a thickness of the conveyor belt is t (mm), a width of the conveyor belt in the axial direction of the driving roller is Bw (mm), a vertical elasticity coefficient in a width direction of the conveyor belt is E (g/mm$^2$), a load applied to the conveyor belt to stretch the conveyor belt is W (g/mm), and a diameter of the driving roller is D (mm), a distance L (mm), between the regulation member and the one end face of the driving roller is set so as to satisfy a following relationship:

$$L<(42.3\times D\times E\times t\times 10^{-3})/(W\times Bw).$$

* * * * *